United States Patent [19]

Todokoro

[11] Patent Number: 4,949,967

[45] Date of Patent: Aug. 21, 1990

[54] TENNIS GAME BOARD

[76] Inventor: Masatoshi Todokoro, 2-33, Koganehara 2-chome, Matsudo-shi, Chiba-ken, Japan

[21] Appl. No.: 366,470

[22] Filed: Jun. 15, 1989

[51] Int. Cl.[5] ..... A63F 7/06; A63F 7/20

[52] U.S. Cl. ..... 273/85 D; 273/129 Q; 273/119 R; 273/129 V; 273/120 R

[58] Field of Search ..... 273/120 R, 120 A, 129 Q, 273/85 R–85 F, 94, 89, 119 R, 129 V

[56] References Cited

U.S. PATENT DOCUMENTS

| | | | |
|---|---|---|---|
| 2,490,288 | 12/1949 | Wickersham | 273/129 Q X |
| 2,815,213 | 12/1957 | Wisener | 273/129 Q X |
| 3,227,452 | 1/1966 | Murphy | 273/129 Q X |
| 3,782,726 | 1/1974 | Huffman et al. | 273/94 R |
| 3,995,859 | 12/1976 | Goldfarb et al. | 273/85 B |
| 4,042,239 | 8/1977 | Cecchetti | 273/85 F |
| 4,210,331 | 7/1980 | Kulesza et al. | 273/120 R |
| 4,251,074 | 2/1981 | Welker | 273/89 |
| 4,286,785 | 9/1981 | Todokoro | 273/85 D |

*Primary Examiner*—Edward M. Coven
*Assistant Examiner*—Sebastiano Passaniti
*Attorney, Agent, or Firm*—George B. Oujevolk

[57] ABSTRACT

In the tennis game board, each of the racket-supporting bodies that are reciprocally movable along each end of the base board is provided with a ball delivery member, which directly feeds the ball onto the board surface as if the ball was served by one of the racket-supporting bodies. After this, the ball on the board surface of the base board is hit alternately by the opposedly disposed racket-supporting bodies, thus enabling the game like tennis to be performed.

8 Claims, 6 Drawing Sheets

TENNIS GAME BOARD

BACKGROUND OF THE INVENTION

1. Field of the Invention

The present invention relates to a game board, and more particularly to a game board to play a game similar to tennis.

2. Brief Review of the Prior Art

The present invention is an improvement over the tennis game board described in the Masatoshi Todokoro U.S. Pat. No. 4,286,785. This U.S. Patent in turn is based on the Japanese Utility Model publications set forth on page 1 of the aforesaid U.S. Pat. No. 4,286,785, which are listed as follows: Aug. 16, 1979 [JP] Japan No. 54/112569 [U] now 43353/1981 Aug. 16, 1979 [JP] Japan No. 54/112570 [U] now 43354/1981 Aug. 16, 1979 [JP] Japan No. 54/112571 [U] now 43355/1981 Aug. 16, 1979 [JP] Japan No. 54/112572 [U] now 24508/1987; also, Aug. 10, 1987 Japanese unexamined Utility Model Appln. No. 125577/1987 (not listed in this U.S. Pat. No. 4,286,785).

3. Summary of the Invention

Generally speaking, the present invention contemplates a tennis game board on which are racket-supporting bodies which may be shaped like little dolls holding tennis rackets. These bodies are reciprocally movable along each end of the base of the game board. The game board is provided with a ball delivery member which directly feeds the ball onto the board surface as if the ball was served by one of the racket-supporting bodies. After this, the ball on the surface of the game board is hit alternately by the opposedly disposed racket-supporting bodies, so that a game like tennis takes place.

BRIEF DESCRIPTION OF THE DRAWINGS

The invention as well as other objects and advantages of the invention will be more readily apparent from the following detailed description when taken together with the accompanying drawings, in which.

DETAILED DESCRIPTION OF THE PREFERRED EMBODIMENT

Figure 1:
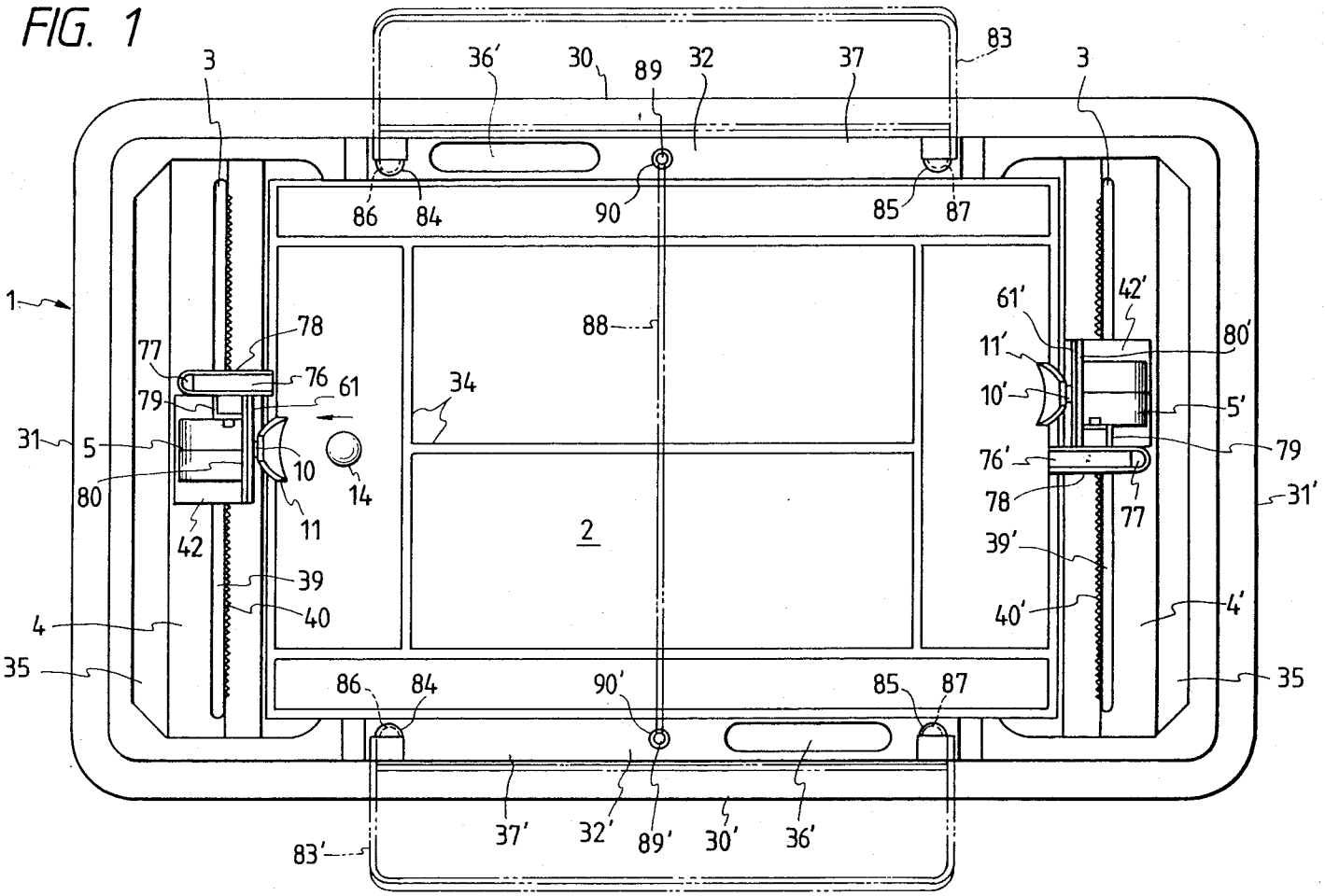
FIG. 1 is a plan view of the tennis game board of the invention contemplated herein.
Figure 2:
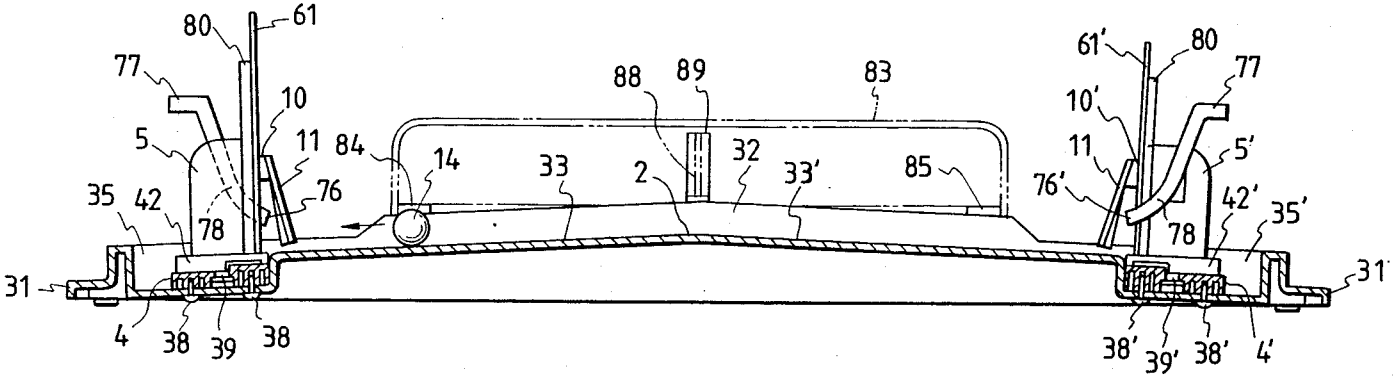
FIG. 2 is a side view of the tennis game board, shown partly in cross section.
Figure 4:
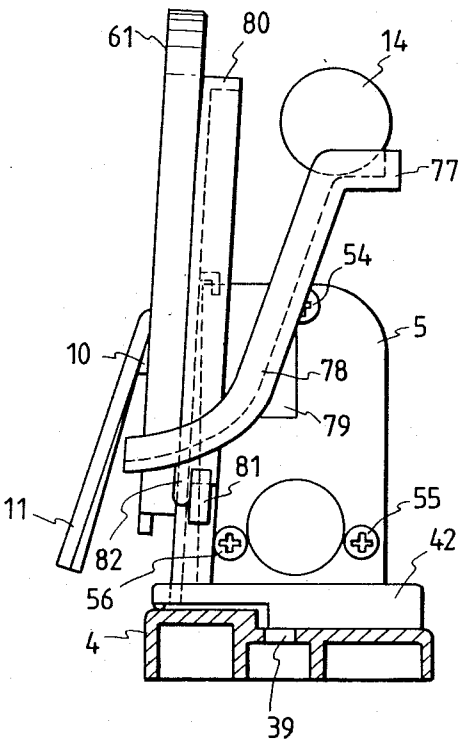
FIG. 4 is an enlarged side elevational view of the racket-supporting body.
Figure 3:
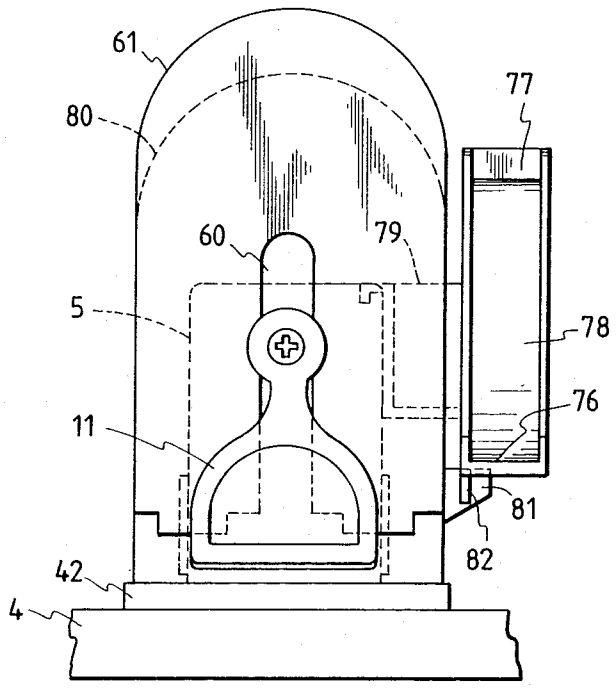
FIG. 3 is an enlarged front elevational view of a racket-supporting body.

In the drawings, there is shown a base board 1, which has a board surface 2 formed in the likeness of a tennis-court and floor plates 4, 4' having guide rail portions 3, 3' parallel to the ends of the board surface 2. On the base board are hollow racket-supporting bodies 5, 5' that are reciprocally moved between the ends of each floor plate 4, 4', guided along the guide rail portions 3, 3'. The racket-supporting bodies 5, 5' each have a racket drive shaft 7 rotatably supported on its side walls 6, 6' at the uppor front part thereof. Secured to the central portion of each racket drive shaft 7 are support shafts 10, 10' that project outwardly from the front part of the racket-supporting bodies 5, 5' through a hole 9 cut in the front wall 8 of the bodies. At the front end of the support shafts 10, 10', rackets 11, 11' are attached suspended. Designated 12 is a main shaft which is disposed parallel to the racket drive shaft 7 in the racket-supporting bodies 5, 5' and which is rotatably supported on the side walls 6, 6' at the central portions thereof. Denoted 13 is a cam plate mounted on the main shaft 12 which has an action curve 15 for transmitting to the racket 11, 11' a motion to hit a metal ball 14. The cam plate 13 also has a step 16 to stop the rotation of the cam plate 13 each time the racket 11, 11' returns to the ball hitting start position after hitting the ball 14. Numeral 17 denotes a link that engages with the action curve 15 and transmits the ball hitting motion to the racket 11, 11'. The link 17 has its upper end 18 rigidly secured to the racket drive shaft 7. The other end of the link 17 facing the action curve 15 is provided with a cam follower 19. 20 is a box rigidly mounted to the cam plate which accommodates a windup spring (not shown) for conveying a rotating force to the cam plate 13. 21 is a winding mechanism connected to the windup spring to wind it up. A stopper 22 is adapted to prevent the racket 11, 11' from overrunning. The stopper 22 has engagement projections 27, 28 formed on the pivotal portion 24 rotatably supported on a support shaft 23, the support shaft 23 projecting inwardly from the lower part of one side wall 6 of the racket-supporting body 5, 5'. The engagement projections 27, 28 come into engagement with the step 16 of the cam plate 13 and with the lower end 25 of the link 17, simultaneously, when the racket 11, 11' has moved to a position immediately before the ball hitting position. A spring 29 urges the stopper 29 so that the engagement projections 27, 28 press against the step portion 16 of the cam plate 13 and the lower end 25 of the link 17. Ball delivery members 76, 76' are provided to the opposing sides of the racket-supporting bodies 5, 5' and each consist of a ball gutter portion 77 and a ball leading portion 78. The ball gutter portion 77 is located above the racket-supporting body 5, 5' and formed to accommodate the ball 14. The ball leading portion 78 is recessed in cross section and sloped along its length downwardly from the ball gutter portion 77 toward the front of the racket-supporting body 5, 5'. The ball leading portion 78 is at the same time so curved that its inclination gradually decrease until it slightly projects from the front of the racket-supporting body 5, 5'. On the side of the ball leading portion 78 is provided a mounting plate 79 that is removably attached to the side of the racket-supporting body 5, 5'. At the lower end of the ball leading portion 78 is provided a projection 82 that can removably attaches to the retainer projection 81 which is provided to the side of the support plate 80, 80' erected and attached to the front part of the racket-supporting body 5, 5'. The ball delivery members 76, 76' may be provided on the same sides of the racket-supporting bodies 5, 5'.

Next, the sequence of operation of the racket-supporting bodies 5, 5' in the above embodiment are explained in detail. First, the spring in the box 20 is wound up by the winding mechanism 21 for each racket-supporting body 5, 5'. During this process, the engagement projection 27 of the stopper 22 is urged by the spring 29 to engage the step 16 of the cam plate 13, thus stopping the rotation of the cam plate 13. At the same time, the engagement projections 28 of the stopper 22 is also urged by the spring 29 to engage the lower end 25 of the link 17, causing the racket 11, 11' to be located immediately before the position where it begins to swing and hit the ball 14.

Figure 6:
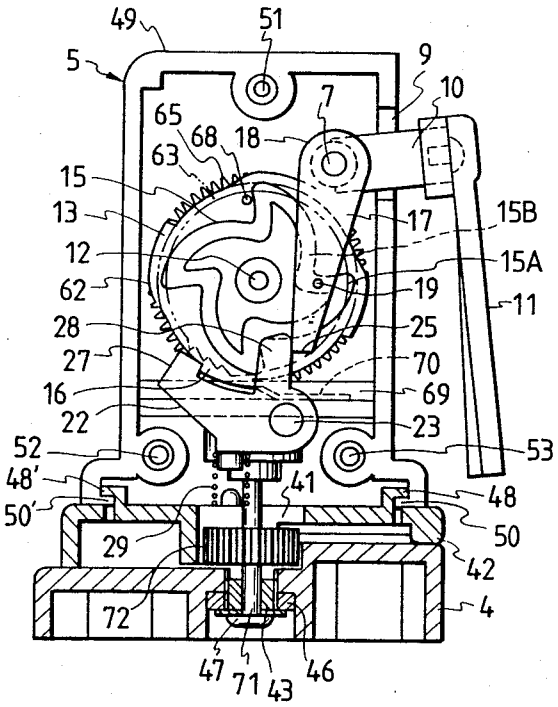
FIG. 6 is side elevational view of FIG. 5, as seen from the right-hand side.
Figure 5:
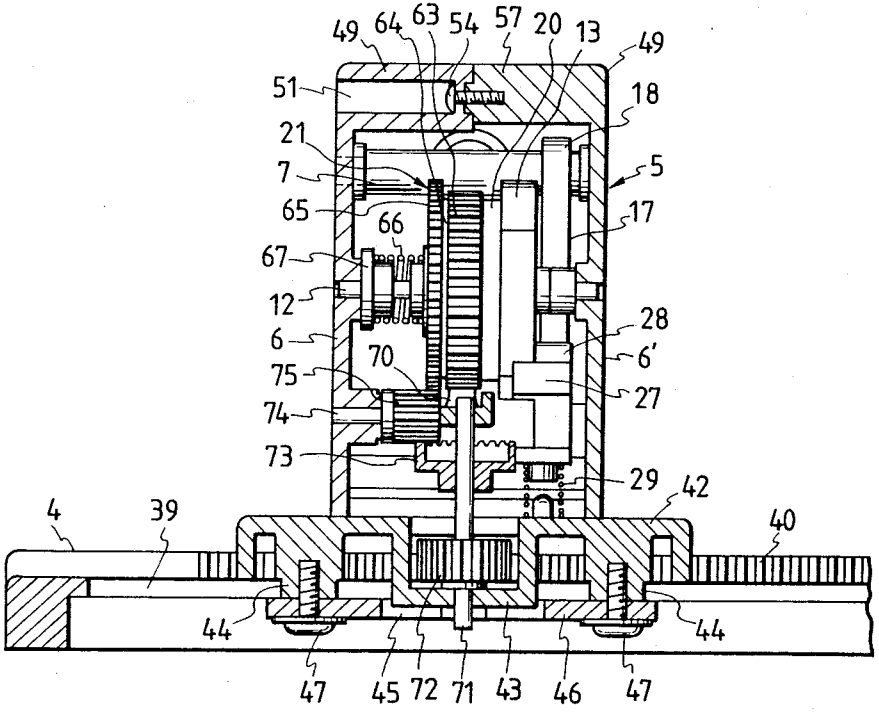
FIG. 5 is an enlarged cross-sectional view showing the internal construction of the racket-supporting body.
Figure 7:
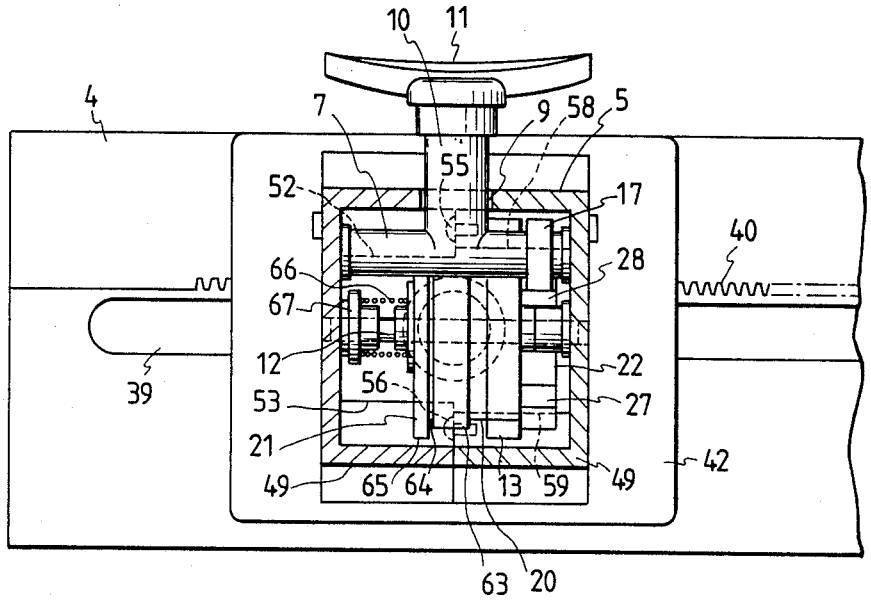
FIG. 7 is a plan view of FIG. 5, shown partly in cross section.
Figure 8:
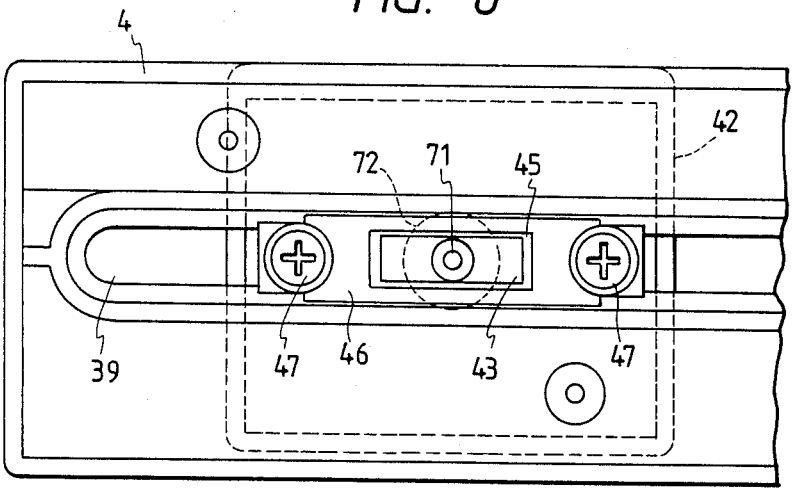
FIG. 8 is a bottom view of FIG. 7.

In this condition, the engagement between the cam follower 19 and the action curve 15 is such that the cam follower 19 can reciprocate through the curve section 15A of the action curve 15 that transmits the swing-down motion to the racket 11, 11', as shown in FIG. 6. So, when an operator picks up the racket 11, 11' with finger tips to move it to the swing-up position and then releases it, the racket 11, 11' returns to the original position by its own weight.

When the windup spring is fully wound up, the ball 14 is placed on the ball gutter portion 7 of the ball delivery member 76 on, say, the racket-supporting body 5, which is chosen to act as a server. The ball 14 on the gutter portion 7 is lightly pushed to send it through the ball delivery member 76 toward the other racket-supporting body 5', which is acting as a receiver. Now, the tennis game is started.

A player who operates the receiver racket-supporting body 5' quickly moves the body 5' on the floor plate 4' to a position where it can receive the approaching ball 14 with the racket 11'.

Figure 9:
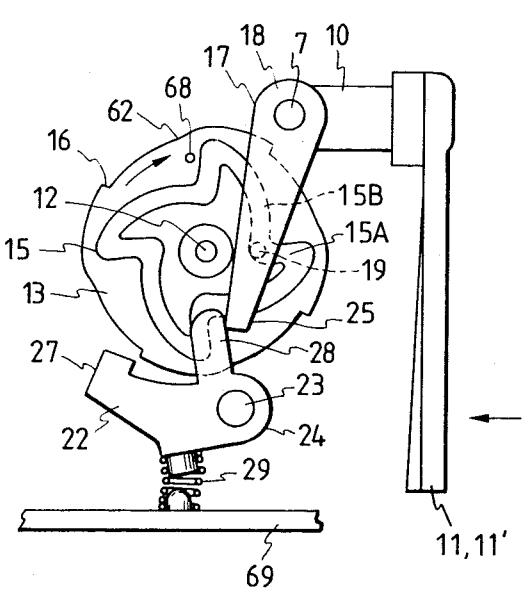
FIG. 9 is a view showing the racket starting to hit a ball.

When the ball hits the racket 11', the lower end of the racket 11' is pushed in the direction of arrow in FIG. 9. This racket movement is transmitted through the support shaft 10 and the racket drive shaft 7 to the link 17, which is rotated about the racket drive shaft 7 to the ball hitting start position. The cam follower 19 is moved to the start position of the curve section 15B of the action curve 15 that transmits the racket swing-up motion to the racket 11'. At the same time, the lower end 25 of the link 17 presses the engagement projection 28 against the force of the spring 29, causing the engagement projection 27 to turn about the support shaft 23 against the force of the spring 29 to a position where it disengages from the step 16 of the cam plate 13. As a result, the cam plate 13 is rotated in the direction of arrow by a rotating force stored in the windup spring. Then, the curve section 15B of the action curve 15 quickly rotates about the main shaft 12 while engaging with the cam follower 19. This transmits the swing-up motion to the racket 11' through the link 17, racket drive shaft 7 and support shaft 10, causing the racket 11' to hit and return the ball 14 toward the opposite end where the racket-supporting body 5' is located.

Figure 10:
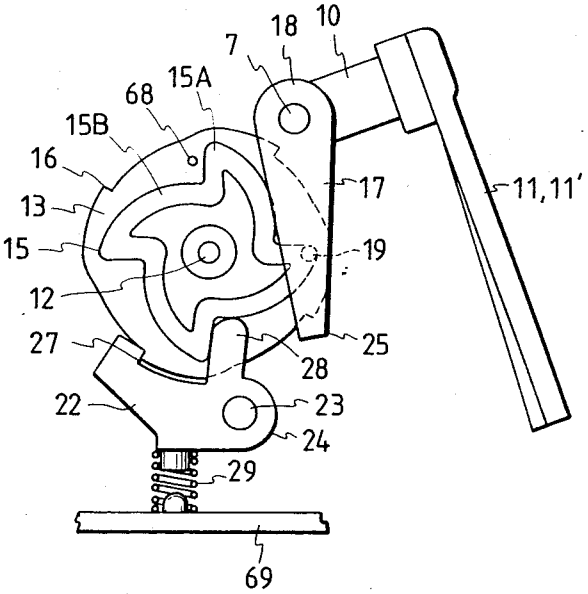
FIG. 10 is a view showing the racket swung up.

When the racket 11' is swung up, the engagement projection 27 reaches a position where it engages the step 16 of the cam plate 13, as shown in FIG. 10. Because the engagement projection 27 is urged by the spring 29 to engage the step 16, the rotation of the cam plate 13 in the direction of arrow stops. By this time, the cam follower 19 has moved to the curve section 15A next to the curve section 15B of the action curve 15, so that it can move back down the cruve section 15B. As a result, the racket 11' is swung down by gravity and its motion is transmitted through the support shaft 10 and the racket drive shaft 7 to the link 17. The link 17 therefore is rotated about the racket drive shaft 7 toward the original position. When the racket 11' is lowered to a position immediately before the ball hitting start position, the lower end 25 of the link 17 abuts against the engagement projection 28 fo the stopper 22, stopping the link 17 at the original position. The racket 11' is now ready to hit the ball 14 rolling toward it.

A player operating the server racket-supporting body 5 swiftly moves the racket-supporting body 5 on the floor plate 4 to a position where it can receive the ball 14 that was hit by the racket 11' and sent rolling toward it.

When the ball 14 hits the racket 11, the same action that occurred with the racket 11' also proceeds with the racket 11, which strikes the ball 14 back toward the opposite board end where the receiver racket-supporting body 5' is installed.

In this way, the racket-supporting bodies 5, 5' are alternately moved toward the rolling ball 14 and hit it by the racket 11, 11'. When the racket-supporting body 5 or 5' fails to hit the ball 14, a point is given to the opponent racket-supporting body. The above operation is repeated to continue the game like a tennis.

The construction of the above embodiment is described in more detail in the following. The base board 1 has opposing longer sides 30, 30' and shorter sides 31, 31' that are connected with the longer sides. On the upper surface of the base board 1, fence walls 32, 32' are provided along the opposing longer sides 30, 30'. The board surface 2 has a summit portion formed along the line connecting the centers of the fence walls 32, 32'. From the summit portion, inclined surfaces 33, 33' slope downwardly toward the longitudinal ends of the board surface 2. On the board surface 2, white lines similar 34 to those on the tennis-court are marked. Between the ends of the board surface 2 and the shorter sides 31, 31' are provided recesses 35, 35'. On the upper surface of the fence walls 32, 32' are formed grooves 36, 36' to store the balls 14. The grooves 36, 36' may be formed with outlets near the summit of the board surface 2 to feed tbe ball 14 onto the board surface 2. Outside the fence walls 32, 32', panels 83, 83'—which are formed in the likeness of the stands with an audience illustrated on the surface (not shown)—are arranged in slope. The support shafts 84, 85 on each side of the panels 83, 83' are inserted into the shaft holes 86, 87 provided at each end of the fence walls 32, 32' to fix the panels 83, 83'. A net plate 88 formed in the likeness of the net in the tennis-court is set between the fence walls 32, 32' so that it crosses the central portion of the board surface 2 and that it is spaced from the board surface 2 so as to allow the ball 14 to pass through. The stays 89, 89' at each end of the net plate 88 are inserted at their lower ends into the holes 90, 90' formed at the centers of the fence walls 32, 32' to hold the net plate 88 immovable. The floor plates 4, 4' are installed in the recesses 35, 35' at a position adjoining the board surface 2 and are fixed by screws 38, 38' to the bottom of the recesses 35, 35'. At the longitudinally central portion of the upper surface of each floor plate 4, 4' is formed a slot 39, 39' which extends parallel to the ends of the board surface 2 to form a guide rail portion 3, 3'. The upper surface of the floor plate 4, 4' is formed with a step in such a way that the portion of the floor plate on one side of the slot 39, 39' near the board surface 2 is higher than the other portion on the far side of the slot. The stepped part is formed with a rack gear 40, 40' along the edge of the slot 39, 39'.

On the upper surface of the floor plate 4, 4', a through hole 41, 41' is formed at the center thereof. Also mounted on the upper surface of the floor plate 4, 4' is a moving table 42, 42' that is moved reciprocally between the ends of the floor plate. At the bottom of the moving table 42, 42' are formed a frame 43 and projections 44, 44'. The frame 43 with its sides open projects downwardly at a location corresponding to the slot 39, 39' of the floor plate 4, 4' so that it engages with the slot 39, 39'. The projections 44, 44' are provided on each side of the frame 43 and adapted to engage slidably with the slot 39, 39'. Attached to the lower ends of the projections 44, 44' is a retainer plate 46 that is formed with an opening 45, which is larger in width than the slot 39, 39' and into which the lower ends of the frame 43 is received. The retainer plate 46 is secured to the moving table 42, 42' by screwing the screws 47, 47' at each end of the retainer plate 46 into the projections 44, 44' so that the moving table 42, 42' can smoothly perform the reciprocal motion and also will not come off the floor plate 4, 4' while in reciprocal motion. On the upper surface of the moving table 42, 42' and near the front and rear ends thereof, L-shaped engagement projections 48, 48' are formed each of which projects parallel to the slot 39, 39' and bends outwardly.

The racket-supporting body 5, 5' consists of divided pieces 49, 49' which are separated at the center of the body. The divided pieces 49, 49' are mounted on the moving table 42, 42', and the engagement edges 50, 50' at the lower ends of the divided pieces 49, 49' are engaged with the engagement projections 48, 48'. The mating surfaces of the divided pieces 49, 49' are joined together, and screws 54, 55, 56 are inserted from one of the divided pieces 49 into the other divided piece 49 through the screw insertion holes 51, 52, 53 formed at the upper center and the lower left and right of the divided pieces 49. These screws 54, 55, 56 are then screwed into the threaded holes 57, 58, 59 formed in the second divided piece 49 at positions corresponding to the screw insertion holes 51, 52, 53 in the first piece 49. In this way the divided pieces 49, 49' are fastened together.

The support plate 80, 80' secured to the front of the racket-supporting plate 5, 5' may be attached with a panel 61, 61', which is illustrated with a player or a cartoon character posing to hit the ball with a racket and which is cut with an opening 60 through which the support shaft 10, 10' is passed. The racket-supporting body 5, 5' may be formed like a doll or any other model or may be installed inside a doll or model.

The action curve 15 of the cam plate 13 is a cam groove cut in the surface of the cam plate 13 facing the link 17 in such a way that the cam follower 19 can engage the action curve. The action curve 15 is made up of a curve section 15B which transmits a swing-up motion to the racket 11, 11' and a curve section 15A which produces a swing-down motion, with these curve sections arranged alternately about the main shaft at 90-degree steps and in communication with each other. For each revolution of the cam plate 13, the racket 11, 11' is driven four times. The curve section 15A is formed wider than the curve section 15B to allow the cam follower 19 more freedom of motion. The cam plate 13 is provided at its circumference with a rachet wheel 62, which has four equidistantly arranged steps 16 that correspond to the position immediately before the racket 11, 11' starts hitting the ball 14.

Next, we will explain an example of the winding mechanism, 21 for the windup spring. Sleeved at their centers over the main shaft 12 are the cam plate 13 with the box 20 containing the windup spring, a toothed wheel 63, a friction plate 64, a gear 65, a pressing spring 66 and a pressure adjust plate 67. Only the toothed wheel 63 is rigidly secured to the main shaft 12 so that they turn together and that the cam plate 13, friction plate 64, grear 65 and pressure adjust plate 67 can rotate freely. The outer end of the windup spring in the box 20 is hooked up to a projection 68 that is formed on the cam plate 13 near its circumference. The inner end of the windup spring is hooked up to a projection (not shown) formed on the toothed wheel 63 near its center. Below the toothed wheel 63, a base plate 69 is supported between the front and rear walls of the racket-supporting body 5, 5'. Secured to the upper surface of the base plate 69 is a pawl plate 70, which, when the cam plate 13 rotates in the same direction as the arrow in FIG. 9, allows the toothed wheel 63 to rotate by being pressed against and sliding over the teeth of the toothed wheel 63. When the toothed wheel 63 beings to rotate in the reverse direction, the pawl plate 70 prevents the reverse rotation of the toothed wheel 63. Between the base plate 69 and the frame 43 a vertical shaft 71 is rotatably supported. The vertical shaft 71 is securely mounted near its lower end with a pinion gear 72 that meshes with a rack gear 40, 40' and near its upper end with a crown gear 73. Meshed with the crown gear 73 and the gear 65 is a follower gear 75 which is rotatably supported on the support shaft 74 that projects from the inner wall of the racket-supporting body 5, 5'. The pressing force of the pressing spring 66 can be adjusted by the pressure adjust plate 67 in either of the following ways. During assembly of the winding mechanism 21, the pressure adjust plate 67 may be so set that charging the windup spring one turn will store energy enough to drive the racket, say, 20 times. Or a lever connected to the pressure adjust plate 67 may be projected out of the racket-supporting body 5, 5', so that the force of the pressing spring 66 can be adjusted during the game.

The winding mechanism 21 for the windup spring works as follows. When an operator holds the racket-supporting body 5, 5' by hand and reciprocally moves it along the slot 39, 39', the pinion gear 72 in mesh with the rack gear 40, 40' turns back and forth. The back and forth rotation of the pinion gear 72 is conveyed, through the vertical shaft 71, crown gear 73 and the follower gear 75, to the gear 65. The gear 65 is pressed by the pressing spring 66 against the friction plate 64, which in turn is pressed against the side surface of the toothed wheel 63. Therefore, when the gear 65 rotates in the same direction as indicated by the arrow on the cam plate 13, the toothed wheel 63 is not blocked by the pawl plate 70 and rotates, charging the windup spring. When, however, the gear 65 rotates in the reverse direction, one of the teeth of the toothed wheel 63 engages the end of the pawl plate 70, blocking the reverse rotation of the toothed wheel 63. As a result, the windup spring is kept wound up.

As the above operation is repeated, the winding process proceeds and the windup spring builds up the rotating force. When the winding limit is reached, the accumulated force of the windup spring overcomes the frictional force of the friction plate 64, with the result that the toothed wheel 63 and the gear 65 start sliding on the friction plate 64. Any further rotation of the gear 65 in the direction of arrow will not wind the spring any more.

The rotative force is consumed each time the racket 11, 11' hits the ball 14, and the windup spring gradually loosens. During the game, taking advantage of the idle time in which the player is waiting for the ball 14, the operator may move the racket-supporting body 5, 5' left and right along the slot 39, 39' several times. This causes the gear 65 to rotate and each time the gear 65 turns in the direction of the arrow, the loose spring is wound up, keeping the spring charged to the limit at all times.

Instead of the above winding mechanism, another mechanism may be used which allows manual windup of the spring.

ADVANTAGE OF THE INVENTION

The invention with the above construction has the following advantages. It is possible to deliver the ball from the ball delivery member of the server racket-supporting body onto the board surface at the start of the game as if the server racket-supporting body served the ball to the opponent, thus making the operation of the racket-supporting body more interesting. Since the racket drive mechanism is constructed as described in the above embodiment, after the racket is swung up, it returns by gravity to a position immediately before the ball striking start position and does not overrun that pre-start position. The racket drive shaft also is not applied with excess spring pressure. Therefore, after having hit the ball and before the ball is returned, the racket can be prevented from striking at the air. Further, the action of the racket becomes quick and responsive, so that if the ball strikes the racket with a small force, it is possible for the racket to strike back the ball with a sufficient power. Especially when the action curve is so formed that for each turn of the cam plate the racket is driven four times as in the above embodiment, it is possible to increase the number of times that the racket can be driven by the rotative power stored in the windup spring.

I claim:

1. A tennis game board comprising:

(a) a base board having a board surface formed on its upper surface on which a ball is rolled;

(b) a racket-supporting body mounted at each end of the board surface in such a way that the racket-supporting bodies can be moved along the ends of the board surface;

(c) a main shaft mounted inside the racket-supporting body;

(d) a racket drive shaft mounted inside the racket-supporting body, the racket drive shaft supporting the racket that is used to strike the ball rolling toward it on the board surface;

(e) a cam plate mounted on the main shaft, the cam plate having an action curve that transmits the ball hitting motion to the racket;

(f) a windup spring supported on the main shaft to transmit the rotating force to the cam plate;

(g) a winding mechanism hooked up to the windup spring;

(h) a link coupled to the racket drive shaft, the link having a cam follower that engages the action curve in the cam plate; wherein each of the racket-supporting bodies includes a ball delivery member having a ball gutter portion and a ball leading portion, the ball leading portion being adapted to feed the ball from the ball gutter portion so that the ball will fall rolling onto the board surface at a position close to each racket-supporting body and roll toward the other racket-supporting body at the other end of the board surface;

(i) said ball delivery member consisting of a ball gutter portion disposed above and on the side of the racket-supporting body, with a ball leading portion having a U-shaped cross-section, the ball leading portion extending along a downward slope from the ball gutter portion and projecting slightly from the front of the racket supporting body, the slope becoming gentler as the slope goes downward;

(j) a mounting plate provided to the side of the ball leading portion of the ball delivery member, the mounting plate being capable of being removably attached to the side of the racket-supporting body.

2. A tennis game board as set forth in claim 1, wherein the ball delivery member is provided to the opposite side of the facing racket-supporting bodies.

3. A tennis game board as set forth in claim 1, wherein the ball delivery member is provided to the same side of the facing racket-supporting bodies.

4. A tennis game board as set forth in claim 1, wherein a panel is mounted inclined to the sides of the base board, the panels being formed in the likeness of the stands with its surface illustrated with an audience.

5. A tennis game board as set forth in claim 1, wherein a floor plate is provided to each end of the base board, the floor plates are each provided with a guide rail portion running parallel with the end of the board surface of the base board and also provided with a rack gear running parallel with the guide rail portion, a moving table on which the racket-supporting body is mounted is engaged with each guide rail portion so that it is reciprocally movable along the guide rail portion, and the winding mechanism for the windup spring is connected to the rack gear through a follower gear.

6. A tennis game board as set forth in claim 5, wherein winding mechanism for the windup spring consists of:

a main shaft;

a cam plate with a box containing the windup spring;

a toothed wheel;

a friction plate;

a gear;

a pressing spring; and a pressure adjust plate;

whereby these latter six members are sleeved at their centers over the main shaft with only the toothed wheel rigidly secured to the main shaft, the toothed wheel is engaged with a pawl that prevents the reverse rotation of the toothed wheel, and the gear is in mesh with the follower gear that is rotated when the racket-supporting body is reciprocally moved.

7. A tennis game board as set forth in claim 5, wherein the action curve of the cam plate is a cam groove cut in the cam plate on its surface facing the link so that the cam follower can engage with it, and the cam groove consists of two kinds of curve sections, one section being adapted to transmit the swing-up motion to the racket, the other section being adapted to transmit the swing-down motion to the racket, the two kinds of curve sections being alternately arranged about the main shaft at 90-degree steps and in communication with each other.

8. A tennis game board as set forth in claim 6, wherein a stopper is provided which has engagement projections, and the engagement projections are adapted to engage, by the resilient force of a spring, simultaneously with a step portion formed at the circumference of the cam plate and with the link engaging the action curve of the cam plate when the racket comes to a position immediately before the ball hitting start position.

* * * * *